US006036073A

United States Patent [19]

Newhouse

[11] Patent Number: 6,036,073

[45] Date of Patent: Mar. 14, 2000

[54] NAIL HOLDING AND DRIVING TOOL

[76] Inventor: Richard D. Newhouse, 544 E. Shore Rd., Bergland, Mich. 49910

[21] Appl. No.: 09/137,057

[22] Filed: Aug. 20, 1998

[51] Int. Cl.[7] ..... B25C 1/02

[52] U.S. Cl. ..... 227/147; 227/119; 227/142

[58] Field of Search ..... 227/147, 142, 227/119

[56] References Cited

U.S. PATENT DOCUMENTS

| | | | |
|---|---|---|---|
| 952,571 | 3/1910 | Lamb | 227/147 |
| 2,543,942 | 3/1951 | Shaff | 227/147 |
| 3,391,842 | 7/1968 | Mathes | 227/147 |
| 4,179,058 | 12/1979 | Yost | 227/147 |
| 4,676,424 | 6/1987 | Meador et al. | 227/147 |
| 4,978,047 | 12/1990 | Chen | 227/147 |
| 5,605,271 | 2/1997 | Russell | 227/147 |

*Primary Examiner*—Scott A. Smith

[57] ABSTRACT

A nail holding and driving tool for driving a nail into a structure. The tool includes a body member having opposite first and second ends and a bore therethrough extending between the first and second ends of the body member. The second end of the body member is inserted into an attachment band of a holding member. The holding member has a pair of resiliently deflectable holding arms outwardly extending from the attachment band of the holding member. The holding arms are designed for holding a nail therebetween. A shaft of a driver member is inserted into the bore of the body member through the first end of the body member. The driver member also has a head portion which outwardly extends from the first end of the body member.

13 Claims, 2 Drawing Sheets

NAIL HOLDING AND DRIVING TOOL

BACKGROUND OF THE INVENTION

1. Field of the Invention

The present invention relates to tools for holding and driving nails and more particularly pertains to a new nail holding and driving tool for driving a nail into a structure.

2. Description of the Prior Art

The use of tools for holding and driving nails is known in the prior art. More specifically, tools for holding and driving nails heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,054,237; U.S. Pat. No. 5,529,234; U.S. Pat. No. 4,676,424; U.S. Pat. No. 3,342,228; U.S. Pat. No. 2,672,610; and U.S. Pat. No. Des. 374,802.

While these devices fulfill their respective, particular objectives and requirements, the aforementioned patents do not disclose a new nail holding and driving tool. The inventive device includes a body member having opposite first and second ends and a bore therethrough extending between the first and second ends of the body member. The second end of the body member is inserted into an attachment band of a holding member. The holding member has a pair of resiliently deflectable holding arms outwardly extending from the attachment band of the holding member. The holding arms are designed for holding a nail therebetween. A shaft of a driver member is inserted into the bore of the body member through the first end of the body member. The driver member also has a head portion which outwardly extends from the first end of the body member.

In these respects, the nail holding and driving tool according to the present invention substantially departs from the conventional concepts and designs of the prior art, and in so doing provides an apparatus primarily developed for the purpose of driving a nail into a structure.

SUMMARY OF THE INVENTION

In view of the foregoing disadvantages inherent in the known types of tools for holding and driving nails now present in the prior art, the present invention provides a new nail holding and driving tool construction wherein the same can be utilized for driving a nail into a structure.

The general purpose of the present invention, which will be described subsequently in greater detail, is to provide a new nail holding and driving tool apparatus and method which has many of the advantages of the tools for holding and driving nails mentioned heretofore and many novel features that result in a new nail holding and driving tool which is not anticipated, rendered obvious, suggested, or even implied by any of the prior art tools for holding and driving nails, either alone or in any combination thereof.

To attain this, the present invention generally comprises a body member having opposite first and second ends and a bore therethrough extending between the first and second ends of the body member. The second end of the body member is inserted into an attachment band of a holding member. The holding member has a pair of resiliently deflectable holding arms outwardly extending from the attachment band of the holding member. The holding arms are designed for holding a nail therebetween. A shaft of a driver member is inserted into the bore of the body member through the first end of the body member. The driver member also has a head portion which outwardly extends from the first end of the body member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nail holding and driving tool apparatus and method which has many of the advantages of the tools for holding and driving nails mentioned heretofore and many novel features that result in a new nail holding and driving tool which is not anticipated, rendered obvious, suggested, or even implied by any of the prior art tools for holding and driving nails, either alone or in any combination thereof.

It is another object of the present invention to provide a new nail holding and driving tool which may be easily and efficiently manufactured and marketed.

It is a further object of the present invention to provide a new nail holding and driving tool which is of a durable and reliable construction.

An even further object of the present invention is to provide a new nail holding and driving tool which is susceptible of a low cost of manufacture with regard to both materials and labor, and which accordingly is then susceptible of low prices of sale to the consuming public, thereby making such nail holding and driving tool economically available to the buying public.

Still yet another object of the present invention is to provide a new nail holding and driving tool which provides in the apparatuses and methods of the prior art some of the advantages thereof, while simultaneously overcoming some of the disadvantages normally associated therewith.

Still another object of the present invention is to provide a new nail holding and driving tool for driving a nail into a structure.

Yet another object of the present invention is to provide a new nail holding and driving tool which includes a body member having opposite first and second ends and a bore therethrough extending between the first and second ends of the body member. The second end of the body member is inserted into an attachment band of a holding member. The holding member has a pair of resiliently deflectable holding arms outwardly extending from the attachment band of the holding member. The holding arms are designed for holding a nail therebetween. A shaft of a driver member is inserted into the bore of the body member through the first end of the body member. The driver member also has a head portion which outwardly extends from the first end of the body member.

Still yet another object of the present invention is to provide a new nail holding and driving tool that holds a nail while a user drives the nail into a structure so that the user does not risk accidental injury to their hands from holding the nail.

Even still another object of the present invention is to provide a new nail holding and driving tool that may be used to hold various sizes and lengths of nail with the same tool.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
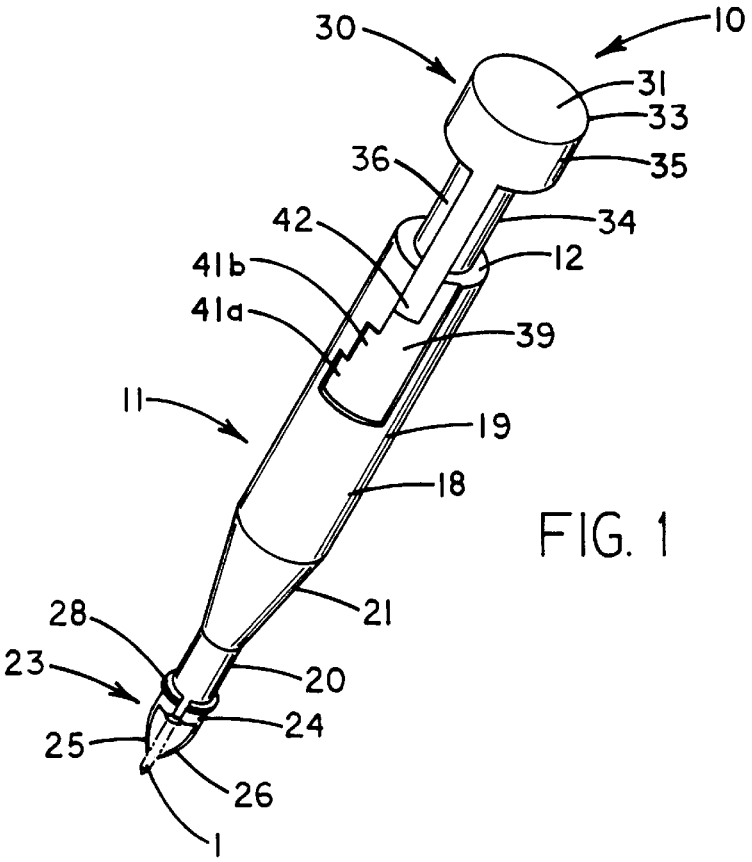
FIG. 1 is a schematic perspective view of a new nail holding and driving tool according to the present invention.
Figure 2:
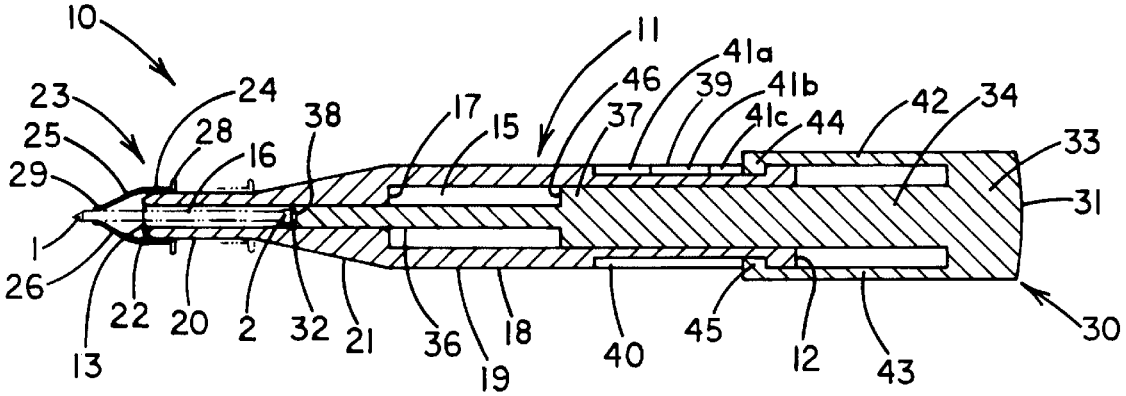
FIG. 2 is a schematic cross sectional view of the present invention.
Figure 3:
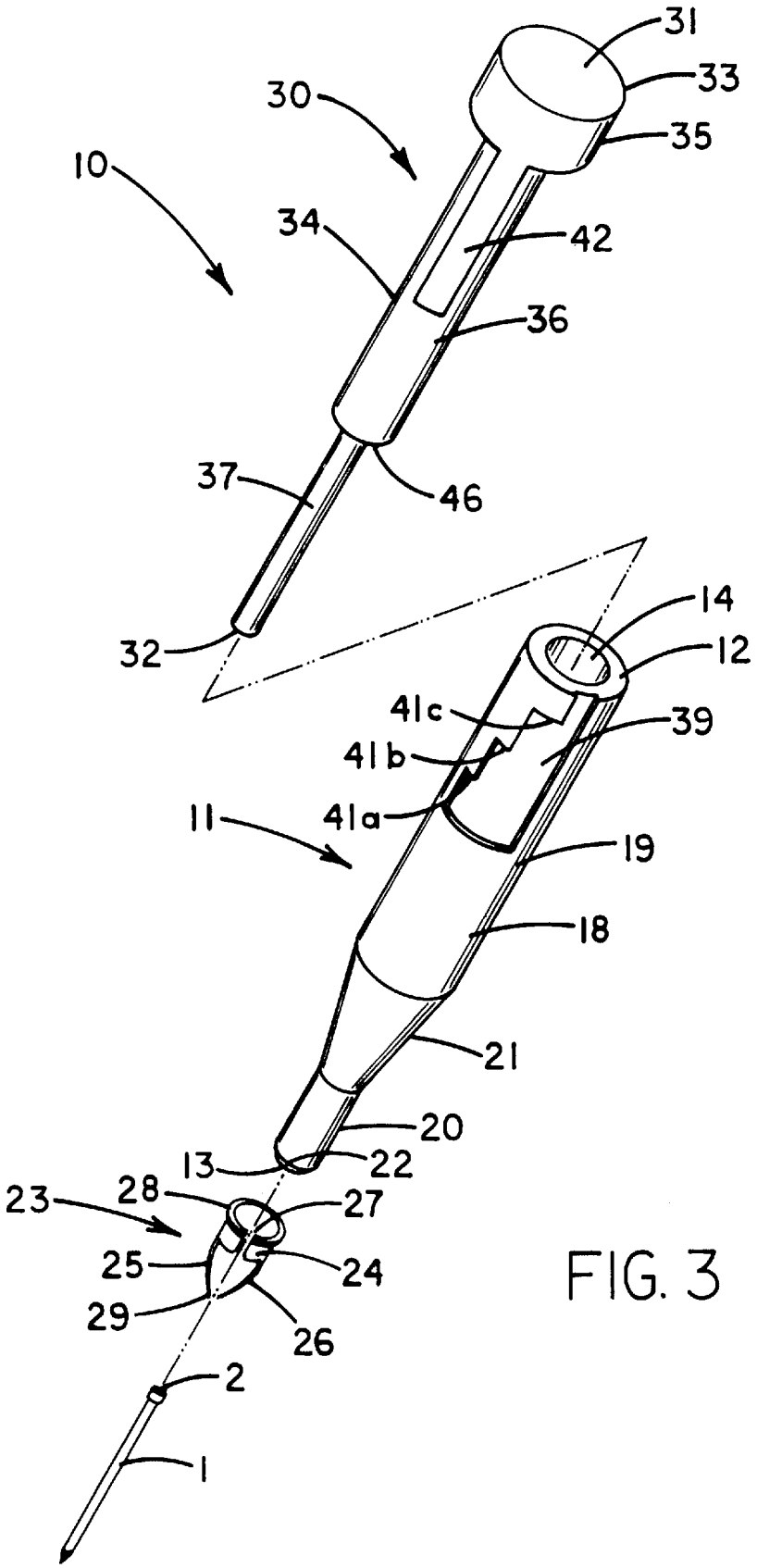
FIG. 3 is a schematic exploded perspective view of the present invention.

With reference now to the drawings, and in particular to FIGS. 1 through 3 thereof, a new nail holding and driving tool embodying the principles and concepts of the present invention and generally designated by the reference numeral 10 will be described.

As best illustrated in FIGS. 1 through 3, the nail holding and driving tool 10 generally comprises a body member 11 having opposite first and second ends 12,13 and a bore 14 therethrough extending between the first and second ends 12,13 of the body member 11. The second end 13 of the body member 11 is inserted into an attachment band 24 of a holding member 23. The holding member 23 has a pair of resiliently deflectable holding arms 25,26 outwardly extending from the attachment band 24 of the holding member 23. The holding arms 25,26 are designed for holding a nail 1 therebetween. A shaft 34 of a driver member 30 is inserted into the bore 14 of the body member 11 through the first end 12 of the body member 11. The driver member 30 also has a head portion 33 which outwardly extends from the first end 12 of the body member 11.

In closer detail, the body member 11 has opposite first and second ends 12,13 and a longitudinal axis extending between the first and second ends 12,13 of the body member 11. The body member 11 also has a bore 14 therethrough extending between the first and second ends 12,13 of the body member 11. The bore 14 has a longitudinal axis preferably coaxial with the longitudinal axis of the body member 11. In use, the bore 14 is designed for receiving the head 2 of a nail 1 inserted therein through the second end 13 of the body member 11. The bore 14 has coaxial first and second portions 15,16. The first portion 15 is located adjacent the first end 12 of the body member 11. The second portion 16 is located adjacent the second end 13 of the body member 11. The first and second portions 15,16 of the bore 14 are each preferably generally cylindrical with the diameter of the first portion 15 greater than the diameter of the second portion 16 of the bore 14 so that the bore 14 has an annular shoulder 17 formed between the first and second portions 15,16 of the bore 14.

The exterior 18 of the body member 11 has first, second and third regions 19,20,21. The first region 19 of the exterior 18 of the body member 11 is located adjacent the first end 12 of the body member 11. The second region 20 of the exterior 18 of the body member 11 is located adjacent the second end 13 of the body member 11. The third region 21 of the exterior 18 of the body member 11 is interposed between the first and second regions 19,20 of the exterior 18 of the body member 11. The first and second regions 19,20 of the exterior 18 of the body member 11 are each generally cylindrical with the diameter of the first region 19 greater than the diameter of the second region 20. The third region 21 is generally frusto-conical and tapers from the first region 19 to the second region 20. Ideally, the second region 20 of the exterior 18 of the body member 11 has an annular beveled edge 22 therearound adjacent the second end 13 of the body member 11.

A spring steel holding member 23 has an annular attachment band 24 and a pair of opposing resiliently deflectable holding arms 25,26 outwardly extending from the attachment band 24. As illustrated in FIGS. 1 and 2, the holding member 23 is designed for holding a nail 1 extended into the bore 14 through the second end 13 of the body member 11. The attachment band 24 of the holding member 23 has a generally cylindrical configuration and has a diameter and a longitudinal break 27 therethrough. The second end 13 of the body member 11 is inserted into the attachment band 24 of the holding member 23 such that the attachment band 24 is disposed around the second region 20 of the exterior 18 of the body member 11. In use, the attachment band 24 of the holding member 23 is slidable along the second region 20 of the exterior 18 of the body member 11 as illustrated in FIG. 2. The attachment band 24 preferably has an outwardly radiating annular lip 28 for aiding sliding of the attachment band 24 of the holding member 23 by a user.

In use, the holding arms 25,26 are designed for holding a nail 1 therebetween. The holding arms 25,26 are generally diametrically positioned along the diameter of the attachment band 24 of the holding member 23. The holding arms 25,26 each have a free end 29 which converge towards one another preferably towards a point along a line extended from the longitudinal axis of body member 11. The free ends 29 of the holding arms 25,26 of the holding member 23 are biased towards each other to help hold a nail 1 extended between the holding arms 25,26. In use, to remove the holding member 23 from the nail 1, the attachment band 24 is slid in a direction towards the first end 12 of the body member 11 to spread apart the holding arms 25,26 away from each other as they are slid on to the second region 20 of the exterior 18 of the body member 11. This action releases the nail 1 between the holding arms 25,26.

The driver member 30 has opposite proximal and distal ends 31,32, a head portion 33 an elongate shaft 34 extending from the head portion 33 of the driver, and a longitudinal axis extending between the proximal and distal ends 31,32 of the driver member 30. In an ideal illustrative embodiment, the driver member 30 has a length defined between the proximal and distal ends 31,32 of about 5 inches. The head portion 33 of the driver member 30 is positioned adjacent the proximal end 31 of the driver member 30. The shaft 34 of the driver member 30 is positioned adjacent the distal end 32 of the driver member 30.

The head portion 33 of the driver member 30 is preferably generally disk-shaped and has a diameter, a perimeter side 35, and a center axis generally coaxial with the longitudinal axis of the driver member 30. In use, the head portion 33 of the driver member 30 is designed for receiving a blow of a hammer thereon. The shaft 34 of the driver member 30 has a longitudinal axis generally coaxial with the longitudinal axis of the driver member 30. The shaft 34 of the driver member 30 has coaxial proximal and distal portions 36,37. The proximal portion 36 of the shaft 34 is positioned adjacent the head portion 33 of the driver member 30. The distal portion 37 of the shaft 34 is positioned adjacent the distal end 32 of the driver member 30. The proximal and distal portions 36,37 of the shaft 34 are each preferably generally cylindrical with the diameter of the proximal portion 36 greater than the diameter of the distal portion 37 so that an annular shoulder 46 is formed therebetween. The shaft 34 of the driver member 30 is inserted into the bore 14 of the body member 11 through the first end 12 of the body member 11 so that the head portion 33 of the driver member 30 outwardly extends from the first end 12 of the body member 11. The distal end 32 of the driver member 30 is extended towards the second end 13 of the body member 11. The distal portion 37 of the shaft 34 is extended into the second portion 16 of the bore 14 and the proximal portion 36 of the shaft 34 is extended into the first portion 15 of the bore 14. The shaft 34 of the driver member 30 is slidable in the bore 14 of the body member 11 along the longitudinal axis of the bore 14 of the body member 11 such that the distal end 32 of the driver member 30 may be moved towards and away from the second end 13 of the body member 11 to drive the nail into a structure when the distal end strikes the head 2 of the nail 1. Preferably, the distal end 32 of the driver member 30 has a depression 38 designed for receiving a head 2 of a nail 1 inserted into the bore 14 of the body member 11 through the second end 13 of the body member 11 as the driver member 30 moves towards the second end 13 of the body member 11 to drive the nail 1 into a structure.

The exterior 18 of the body member 11 has a pair of guide slots 39,40 located adjacent the first end 12 of the body member 11. Each of the guide slots 39,40 has a series of decreasing length steps 41*a*,41*b*,41*c* with each step having a length extending generally parallel to the longitudinal axis of the body member 11. The head portion 33 of the driver member 30 has a pair of guide arms 42,43 extending towards the distal end 32 of the driver member 30 and generally parallel to the longitudinal axis of the driver member 30. Each guide arm is preferably position at diametric points adjacent the perimeter side 35 of the head portion. Each guide arm 42,43 has a tab 44,45 extending towards the shaft 34 of the driver member 30. Each of the tabs 44,45 of the guide arms 42,43 is inserted into an associated guide slot 39,40. In use, movement of the driver member 30 in the bore 14 moves the tabs 44,45 towards the lower ends of the slots. In use the head portion is turned to align the tabs 44,45 with a particular step of the guide slots 39,40 to limit the distance the driver moves in the bore 14 to correspond with the desired depth the nail 1 is to be driven into the structure.

In use, the shaft of the driver member is inserted into the bore of the body member and the tabs of the guide arms arc inserted into the guide slots of the body member. The head of a nail is then inserted into the bore through the second end. Thc nail is also extended between the holding arms of the holding member so that the nail is held in place in the bore of the body member. While holding the body member in one hand, the tip of the nail is positioned on the structure it is to be driven into. The head portion is turned to position the tabs of the guide arms in the desired steps of the guide slots to match the length of the nail and the distance that the user wishes to drive the nail into the structure. The head portion of the driver member is then struck with a hammer to move the distal end of the driver member towards the second end of the body member to drive the nail into the structure. To remover the nail from the tool, the attachment band is slid up the body member towards the first end of the body member to spread apart the holding arms and thereby release the nail.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool, comprising:

a body member having opposite first and second ends, a longitudinal axis extending between said first and second ends of said body member;

said body member having a bore therethrough extending between said first and second ends of said body member;

a holding member having an attachment band and a pair of resiliently deflectable holding arms outwardly extending from said attachment band of said holding member;

said second end of said body member being inserted into said attachment band of said holding member;

said holding arms being adapted for holding a nail therebetween, said holding arms each having a free end, said free ends of said holding arms of said holding member converging towards one another;

said free ends of said holding arms of said holding member being biased towards each other;

a driver member having opposite proximal and distal ends, a head portion and an elongate shaft and a longitudinal axis extending between said proximal and distal ends of said driver member;

said head portion of said driver member being positioned adjacent said proximal end of said driver member, said shaft of said driver member being positioned adjacent said distal end of said driver member;

said shaft of said driver member being inserted into said bore of said body member through said first end of said body member, said head portion of said driver member being outwardly extended from said first end of said body member; and wherein said body member has a pair of guide slots located adjacent said first end of said body member, each of said guide slots having a series of decreasing length steps each having a length extending generally parallel to said longitudinal axis of said body member, wherein said head portion of said driver member having a pair of guide arms extending towards said distal end of said driver member and generally parallel to said longitudinal axis of said driver member, each guide arm having a tab extending towards said shaft of said driver member, each of said tabs of said guide arms being inserted into an associated guide slot.

2. The tool of claim 1, wherein said bore has first and second portions, said first portion being located adjacent said first end of said body member, said second portion being located adjacent said second end of said body member, said first and second portions of said bore each being generally cylindrical and each having a diameter, said diameter of said first portion of said bore being greater than said diameter of said second portion of said bore, said bore having a shoulder being formed between said first and second portions of said bore.

3. The tool of claim 1, wherein said body member has an exterior, said exterior of said body member having first, second and third regions, said first region of said exterior of said body member being located adjacent said first end of said body member, said second region of said exterior of said body member being located adjacent said second end of said body member, said third region of said exterior of said body member being interposed between said first and second regions of said exterior of said body member.

4. The tool of claim 3, wherein said first and second regions of said exterior of said body member each are generally cylindrical and each having a diameter, said diameter of said first region of said exterior of said body region being greater than said diameter of said second region of said exterior of said body member, and said third region of said exterior of said body member being generally frusto-conical and tapering from said first region of said exterior of said body member to said second region of said exterior of said body member.

5. The tool of claim 1, wherein said attachment band of said holding member has a generally cylindrical configuration and having a diameter and a longitudinal break therethrough.

6. The tool of claim 1, wherein said shaft of said driver member has proximal and distal portions, said proximal portion of said shaft being positioned adjacent said head portion of said driver member, said distal portion of said shaft being positioned adjacent said distal end of said driver member, said proximal and distal portions of said shaft each being generally cylindrical and having a diameter, said diameter of said proximal portion of said shaft being greater than said diameter of said distal portion of said shaft.

7. A tool, comprising:

a body member having opposite first and second ends, a longitudinal axis extending between said first and second ends of said body member;

said body member having a bore therethrough extending between said first and second ends of said body member, said bore having a longitudinal axis coaxial with said longitudinal axis of said body member;

said bore having first and second portions, said first portion being located adjacent said first end of said body member, said second portion being located adjacent said second end of said body member;

said first and second portions of said bore each being generally cylindrical and each having a diameter, said diameter of said first portion of said bore being greater than said diameter of said second portion of said bore;

said bore having a shoulder being formed between said first and second portions of said bore;

said body member having an exterior, said exterior of said body member having first, second and third regions, said first region of said exterior of said body member being located adjacent said first end of said body member, said second region of said exterior of said body member being located adjacent said second end of said body member, said third region of said exterior of said body member being interposed between said first and second regions of said exterior of said body member;

said first and second regions of said exterior of said body member each being generally cylindrical and each having a diameter, said diameter of said first region of said exterior of said body region being greater than said diameter of said second region of said exterior of said body member;

said third region of said exterior of said body member being generally frusto-conical and tapering from said first region of said exterior of said body member to said second region of said exterior of said body member;

said second region of said exterior of said body member having a beveled edge therearound adjacent said second end of said body member;

a holding member having an attachment band and a pair of resiliently deflectable holding arms outwardly extending from said attachment band of said holding member;

said attachment band of said holding member having a generally cylindrical configuration and having a diameter and a longitudinal break therethrough;

said second end of said body member being inserted into said attachment band of said holding member such that said attachment band is disposed around said second region of said exterior of said body member;

said attachment band of said holding member being slidable along said second region of said exterior of said body member, said attachment band having an outwardly radiating lip;

said holding arms being adapted for holding a nail therebetween, said holding arms of said holding member being generally diametrically positioned along said diameter of said attachment band of said holding member, said holding arms each having a free end, said free ends of said holding arms of said holding member converging towards one another;

said free ends of said holding arms of said holding member being biased towards each other;

a driver member having opposite proximal and distal ends, a head portion and an elongate shaft, and a longitudinal axis extending between said proximal and distal ends of said driver member;

said head portion of said driver member being positioned adjacent said proximal end of said driver member, said shaft of said driver member being positioned adjacent said distal end of said driver member;

said head portion of said driver member being generally disk-shaped and having a diameter, a perimeter side, and a center axis generally coaxial with said longitudinal axis of said driver member;

said shaft of said driver member having a longitudinal axis generally coaxial with said longitudinal axis of said driver member;

said shaft of said driver member having proximal and distal portions, said proximal portion of said shaft being positioned adjacent said head portion of said driver member, said distal portion of said shaft being positioned adjacent said distal end of said driver member;

said proximal and distal portions of said shaft each being generally cylindrical and having a diameter, said diameter of said proximal portion of said shaft being greater than said diameter of said distal portion of said shaft;

said shaft of said driver member being inserted into said bore of said body member through said first end of said body member, said head portion of said driver member being outwardly extended from said first end of said body member, said distal end of said driver member being extended towards said second end of said body member, said distal portion of said shaft being extended into said second portion of said bore, said proximal portion of said shaft being extended into said first portion of said bore;

said shaft of said driver member being slidable in said bore of said body member along said longitudinal axis of said bore of said body member;

said distal end of said driver member having a depression adapted for receiving a head of a nail;

exterior of said body member having a pair of guide slots located adjacent said first end of said body member, each of said guide slots having a series of decreasing length steps each having a length extending generally parallel to said longitudinal axis of said body member; and said head portion of said driver member having a pair of guide arms extending towards said distal end of said driver member and generally parallel to said longitudinal axis of said driver member, each guide arm having a tab extending towards said shaft of said driver member, each of said tabs of said guide arms being inserted into an associated guide slot.

8. A tool, comprising:

a body member having opposite first and second ends, a longitudinal axis extending between said first and second ends of said body member;

said body member having a bore therethrough extending between said first and second ends of said body member;

a holding member having an attachment band and a pair of resiliently deflectable holding arms outwardly extending from said attachment band of said holding member;

said second end of said body member being inserted into said attachment band of said holding member;

said holding arms being adapted for holding a nail therebetween, said holding arms each having a free end, said free ends of said holding arms of said holding member converging towards one another;

said free ends of said holding arms of said holding member being biased towards each other;

a driver member having opposite proximal and distal ends, a head portion and an elongate shaft and a longitudinal axis extending between said proximal and distal ends of said driver member;

said head portion of said driver member being positioned adjacent said proximal end of said driver member, said shaft of said driver member being positioned adjacent said distal end of said driver member;

said shaft of said driver member being inserted into said bore of said body member through said first end of said body member, said head portion of said driver member being outwardly extended from said first end of said body member; and wherein said body member has at least one guide slot located adjacent said first end of said body member, said guide slot having a series of decreasing length steps each having a length extending generally parallel to said longitudinal axis of said body member, wherein said head portion of said driver member has at least one guide arm extending towards said distal end of said driver member and generally parallel to said longitudinal axis of said driver member, said guide arm having a tab extending towards said shaft of said driver member, said tab of said guide arm being inserted into an associated guide slot.

9. The tool of claim 8, wherein said bore has first and second portions, said first portion being located adjacent said first end of said body member, said second portion being located adjacent said second end of said body member, said first and second portions of said bore each being generally cylindrical and each having a diameter, said diameter of said first portion of said bore being greater than said diameter of said second portion of said bore, said bore having a shoulder being formed between said first and second portions of said bore.

10. The tool of claim 8, wherein said body member has an exterior, said exterior of said body member having first, second and third regions, said first region of said exterior of said body member being located adjacent said first end of said body member, said second region of said exterior of said body member being located adjacent said second end of said body member, said third region of said exterior of said body member being interposed between said first and second regions of said exterior of said body member.

11. The tool of claim 10, wherein said first and second regions of said exterior of said body member each are generally cylindrical and each having a diameter, said diameter of said first region of said exterior of said body region being greater than said diameter of said second region of said exterior of said body member, and said third region of said exterior of said body member being generally frusto-conical and tapering from said first region of said exterior of said body member to said second region of said exterior of said body member.

12. The tool of claim 8, wherein said attachment band of said holding member has a generally cylindrical configuration and having a diameter and a longitudinal break therethrough.

13. The tool of claim 8, wherein said shaft of said driver member has proximal and distal portions, said proximal portion of said shaft being positioned adjacent said head portion of said driver member, said distal portion of said shaft being positioned adjacent said distal end of said driver member, said proximal and distal portions of said shaft each being generally cylindrical and having a diameter, said diameter of said proximal portion of said shaft being greater than said diameter of said distal portion of said shaft.

* * * * *